US005613721A

United States Patent [19]

Mullins

[11] Patent Number: 5,613,721

[45] Date of Patent: Mar. 25, 1997

[54] RETRIEVING AID

[76] Inventor: Johnnie M. Mullins, P.O. Box 1504, Flemingtown, Clintwood, Va. 24228

[21] Appl. No.: 586,315

[22] Filed: Jan. 17, 1996

[51] Int. Cl.[6] ..... B66C 1/10

[52] U.S. Cl. ..... 294/82.1; 294/1.1

[58] Field of Search ..... 294/15, 26, 66.1, 294/67.2, 67.22, 82.1, 82.11, 82.33, 82.34, 82.31, 86.24, 90, 97, 1.1; 114/304, 307, 309

[56] References Cited

U.S. PATENT DOCUMENTS

| | | | |
|---|---|---|---|
| 511,788 | 1/1894 | McDonald | 114/304 |
| 827,246 | 7/1906 | Livingston . | |
| 851,732 | 4/1907 | Deschambault | 294/82.1 X |
| 905,399 | 12/1908 | Zimmerman | 294/82.1 |
| 921,146 | 5/1909 | Naul | 294/86.24 |
| 1,271,435 | 7/1918 | Cloutier . | |
| 1,334,839 | 3/1920 | Cole . | |
| 1,476,627 | 12/1923 | Luebke et al. | 294/82.1 |
| 1,492,970 | 5/1924 | Elliott | 294/86.24 |
| 2,214,660 | 9/1940 | Darling . | |
| 2,461,941 | 2/1949 | Sutton . | |
| 2,496,822 | 2/1950 | Stoddard . | |
| 2,549,573 | 4/1951 | Clark . | |
| 2,681,248 | 6/1954 | Luper | 294/97 |
| 2,987,028 | 6/1961 | Fair | 114/309 X |
| 3,233,933 | 2/1966 | Coski | 294/82.1 X |
| 3,873,068 | 3/1975 | Allen | 294/26 X |
| 4,108,484 | 8/1978 | Malroit . | |
| 5,388,877 | 2/1995 | Wenk . | |

FOREIGN PATENT DOCUMENTS

| | | | |
|---|---|---|---|
| 42422 | 2/1926 | Norway | 294/82.1 |
| 140174 | 4/1953 | Sweden | 294/82.1 |

*Primary Examiner*—Johnny D. Cherry
*Attorney, Agent, or Firm*—Laubscher & Laubscher

[57] ABSTRACT

An apparatus for raising, lowering, or retrieving an article, such as an arrow or an article of clothing, to or from an elevated position relative to the ground, such as a tree stand, includes a foldable hook assembly connected with a cord. The foldable hook assembly includes a pair of spaced generally parallel body members defining a space therebetween adapted to receive an arrow, spacers arranged between the body members, and a pair of fork arms pivotally connected with the body members. The fork arms are provided with angled surfaces which facilitate engagement of the item and allow the apparatus to slide along the ground. The ends of the fork arms are provided with barbs which allow soft articles, such as articles of clothing, to be engaged.

6 Claims, 2 Drawing Sheets

RETRIEVING AID

BACKGROUND OF THE INVENTION

1. Field of the Invention

The present invention relates to a device for raising and lowering items, such as arrows or articles of clothing, to and from an elevated position, such as a tree stand, or for retrieving items which have fallen from the elevated position.

2. Brief Description of the Prior Art

When hunting from a tree stand, a hunter must transport a considerable amount of equipment, such as a firearm, bow and arrow, coveralls, rain gear, equipment belt, and backpack, up to the tree stand. Carrying this equipment while attempting to climb the tree is awkward and dangerous. The present invention allows the hunter to climb to the tree stand unencumbered. Then, once safely positioned in the tree stand, the hunter is able to raise the equipment from ground level or to retrieve items which have fallen without climbing down from the tree stand.

Transporting equipment down from the tree stand poses similar risks and hazards. In addition, throwing equipment to the ground can damage the equipment and produces noise which can scare away potential prey. The present invention allows the hunter to carefully raise and quietly lower the equipment without damaging the equipment.

The Wenk U.S. Pat. No. 5,388,877 discloses a hunting bow retrieval device which allows a tree bound hunter to raise and lower the hunting bow to the hunting position. This complex device includes a reel mounted in an enclosed palm-sized casing. The casing includes a foldable handle assembly which engages the reel and imparts rotational movement thereto. A line wound on the reel extends out of the casing and carries at its lower end an open hook which permits remote release of the bow. The device also includes a thumb brake which allows the line to be controllably released from the wound position. The configuration of the hook would make it difficult to maneuver from an elevated perch so that the article to be retrieved can be secured.

The Cloutier U.S. Pat. No. 1,271,435 discloses a clothes hook for retrieving an article of clothing which has fallen from a clothes line. The device includes a string connected with V-shaped members which are bent at their free ends to form hooks which are best suited for retrieving plush items.

These devices are difficult to position so that the article being retrieved can be securely hooked. Moreover, neither can effectively retrieve an arrow.

The present invention was developed to overcome these and other drawbacks of the prior devices by providing an improved retrieval apparatus which includes a foldable hook assembly connected with a string or cord. The hook assembly includes a pair of spaced body members, a pair of fork arms adapted to receive an arrow therebetween pivotally connected with the body members, and stop members for preventing rotation of the fork arms beyond a predetermined position.

SUMMARY OF THE INVENTION

Accordingly, a primary object of the present invention is to provide a retrieval apparatus which can be easily and accurately maneuvered to allow an article, such as an arrow, to be raised or lowered relative to an elevated position.

It is a more specific object of the invention to provide a retrieval apparatus which includes a foldable hook assembly connected with a cord. The hook assembly includes a pair of spaced body members, a pair of fork arms pivotally connected with the body members, and stop members arranged to prevent the fork arms from pivoting beyond a pre-set position.

It is another object of the invention to provide a retrieval apparatus which is compact, durable, easy to use, and easily and inexpensively produced.

It is a further object of the present invention to provide a retrieval apparatus which allows a hunter to retrieve an arrow which has fallen from a tree stand.

It is yet another object of the invention to provide a collapsible retrieval apparatus which folds into a compact arrangement that fits easily into a pocket.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
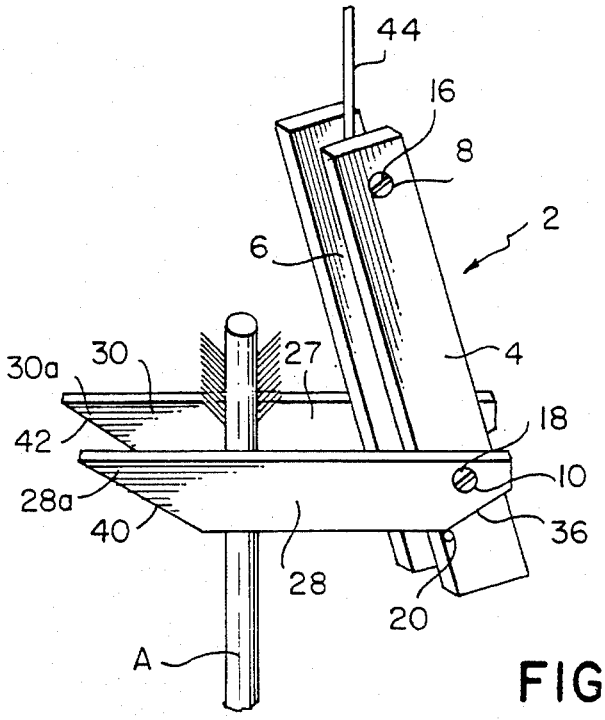
FIG. 1 is a perspective view of the apparatus according to the invention shown in its operative condition.
Figure 2:
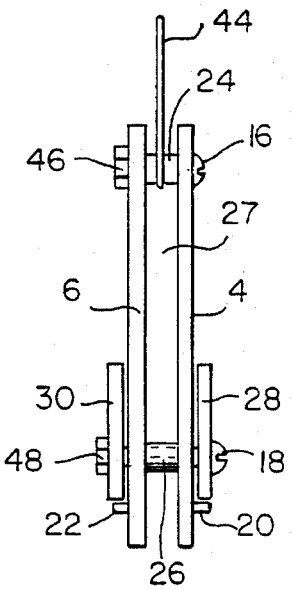
FIG. 2 is an end view of the invention.
Figure 3:
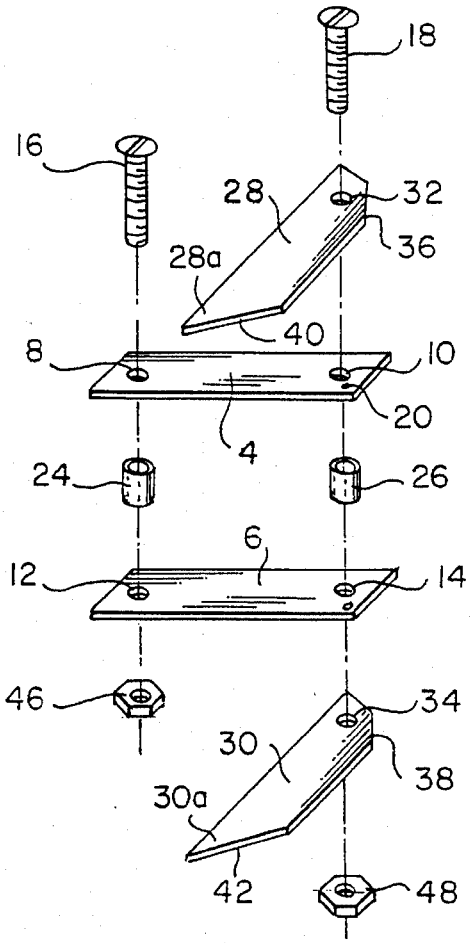
FIG. 3 is an exploded view of the invention.

Referring first to FIGS. 1–3, the retrieval apparatus 2 of the present invention includes a pair of parallel planar rectangularly-shaped body members 4,6 each having a pair of holes 8,10 and 12,14, respectively, adapted to receive a fastener 16,18, such as a screw or pivot pin. Each body member includes a laterally outwardly extending stop projection 20,22.

A pair of hollow cylindrical spacers 24,26 are arranged between body members 4,6. Spacer 24 is aligned with holes 8 and 12 and spacer 26 is aligned with holes 10 and 14. Spacers 24,26 act to define a space or gap 27 between body members 4,6 adapted to receive the shaft of an arrow A.

A pair of parallel planar fork arms 28,30 are pivotally connected with body members 4,6, respectively. Body members 4,6 and fork arms 28,30 are formed of any durable rigid material, preferably cold rolled or stainless steel, or a suitable synthetic plastic material. Fork arm 28 contains a hole 32 which is arranged adjacent to and aligned with hole 10. Fork arm 30 contains a hole 34 which is arranged adjacent to and aligned with hole 14. Each fork arm includes a bevelled surface 36,38 which engages stop projections 20,22, respectively, thereby limiting the degree of rotation of fork arms 28,30, respectively, relative to the associated body member. Fork arms 28,30 also include an angled surface 40,42, thereby forming pointed end portions **28*a*,30*a* of fork arms 28 and 30**, respectively.

A string, cord, or wire 44 is connected with the end of the apparatus opposite from where fork arms 28,30 are connected. This connection is most easily accomplished by simply tying the string 44 around the spacer 24. The string has a length which is sufficient to reach the ground from the elevated position.

Nuts 46,48 are connected with bolts 16,18, respectively. Nut and bolt assembly 18,48 is tightened so that fork arms 28,30 can be pivoted by hand and the amount of play is minimized.

Figure 4:
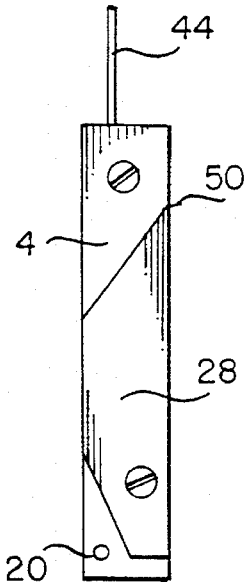
FIG. 4 is a side view of the invention showing the fork arms in the raised position.
Figure 5:
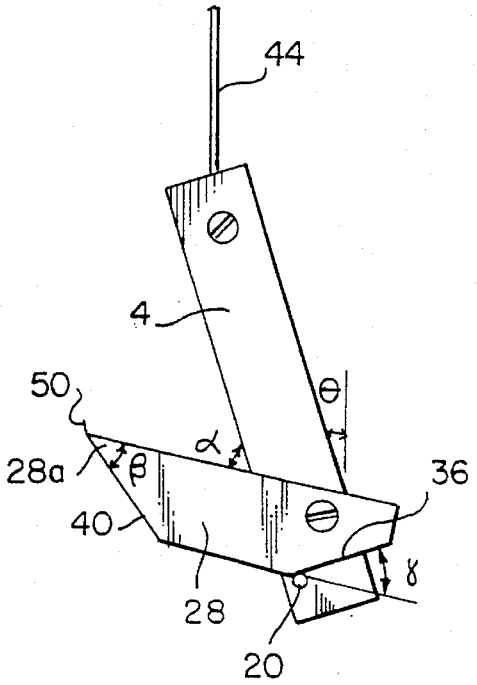
FIG. 5 is a side view of the invention at a suspended elevation showing the fork arms in the lowered position.

The retrieving apparatus is shown in its collapsed or stowed condition in FIG. 4 and in its unfolded condition in FIG. 5. In the stowed condition, fork arms 28,30 are aligned with body members 4,6 and are contained within the side profile of the body members. In this condition, the apparatus is compact enough to fit easily within an ordinary sized pant pocket. In addition, string 44 can be wrapped around the apparatus to prevent the fork arms from inadvertently unfolding.

When in the unfolded position, fork arms 28,30 engage stop members 20,22, respectively, whereby an angle $\alpha$ is formed between the fork arms and the body members which is less than 90 degrees. This is accomplished with bevel surfaces 36,38 forming an angle $\gamma$ of approximately 23 degrees. Having the body members and fork arms arranged in this manner allows the fork arms to slide along the ground when the device is tilted during maneuvering and prevents articles from sliding off of the fork arms when they are being raised or lowered.

To further facilitate maneuvering the tool and retrieving articles, each fork arm includes an angled surface 40,42 forming an angle $\beta$ of approximately 20 degrees. Angled surfaces 40,42 define pointed end portions *28a,30a*, respectively, which make it easier to engage the article being retrieved. Pointed end portions *28a,30a* also allow the device to lean during operation, as discussed below, without having the fork arms dig into the ground.

The tips of pointed end portions *28a,30a* are provided with barbs 50 which allow soft items, such as articles of clothing, to be more easily retrieved. Hard items, such as those formed of metal or plastic, having configurations which do not lend themselves to engagement by the apparatus can be retrieved by attaching a piece of soft material, such as cloth or nylon stocking material, to the item. The barbs are then used to engage the soft material so the item can be retrieved.

Figure 6:
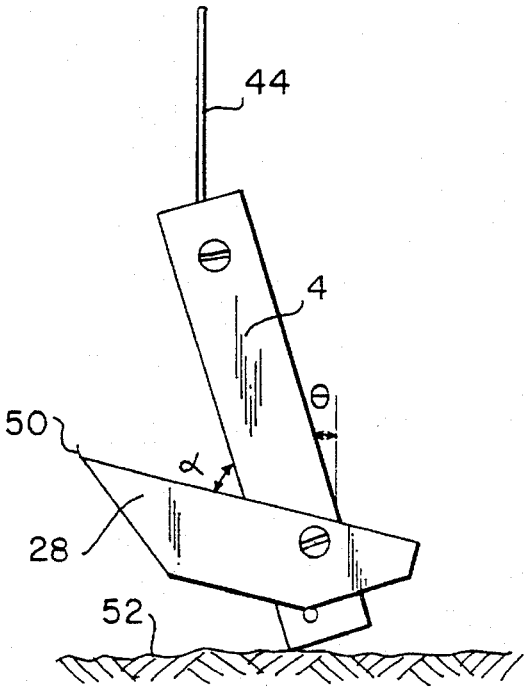
FIG. 6 is a side view of the invention in an initially ground engaged position.
Figure 7:
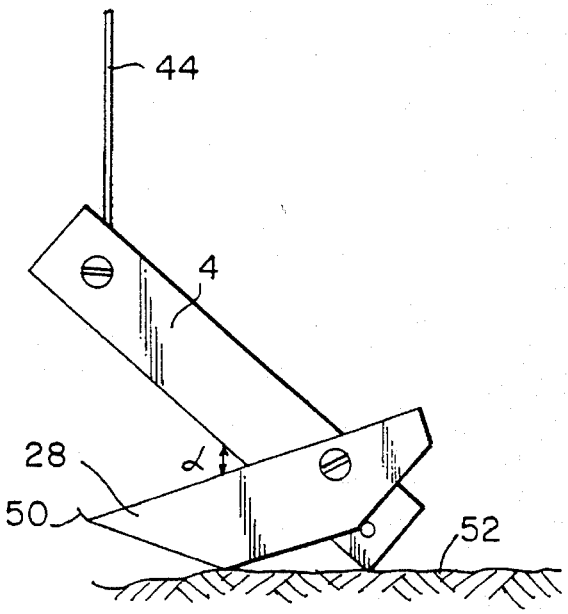
FIG. 7 is a side view of the invention in a fully ground engaged and tilted position.

When the retrieving tool is suspended above ground level and when it initially engages the ground 52, as shown in FIG. 6, body members 4,6 are tilted from the vertical in the direction of the fork arms at an angle $\Theta$. This initial tilt causes the body members to rotate or lean further in the direction of the fork arms as the user lowers the tool into position. When the tool is fully lowered, fork arms 28,30 engage the ground, as shown in FIG. 7. In this manner, barbs 50 are positioned so they can be maneuvered under the article to be displaced.

When the tool is lifted, body members 4,6 rotate back to their original slightly tilted position shown in FIG. 6 causing the fork arms and barbs to engage the article. The angle of the fork arms 28,30 and barbs 50 relative to body members 4,6, causes the article to become even more firmly held by the barbs rather than allowing the article to slide off of the fork arms.

While in accordance with the provisions of the Patent Statutes the preferred forms and embodiments of the invention have been illustrated and described, it will be apparent to those of ordinary skill in the art that various changes and modifications may be made without deviating from the inventive concepts set forth above.

What is claimed is:

1. An article retrieving apparatus, comprising:

(a) an elongated body member having a pair of generally planar parallel side surfaces and further having upper and lower ends;

(b) means connected with said body member upper end for maneuvering said body member;

(c) at least two generally planar parallel fork arms each pivotally connected with said body member lower end, each said fork arm being pivotable between a lowered position wherein said fork arms extend outwardly from said body in the same direction and a folded position wherein each said fork arm is arranged generally parallel and adjacent an associated side surface and further wherein when in said folded position each said fork arm is contained within said body side profile, each said fork arm including:

(1) a tapered end defining a point, and (2) a bevelled abutment surface; and (d) stop means adapted to engage said abutment surface, thereby to limit the range of rotation of said fork arms relative to said body.

2. Apparatus as defined in claim 1, wherein said tapered end of each said fork arm is formed at an angle of generally 20 degrees.

3. Apparatus as defined in claim 1, wherein an angle of less than 90 degrees is formed between said body and each said fork arm when said fork arm is in said extended position.

4. Apparatus as defined in claim 1, wherein said fork arms define a gap therebetween, said gap having a width large enough for the shaft of an archery-type arrow to fit therein and small enough for said arms to engage the feathers of the arrow.

5. Apparatus as defined in claim 1, wherein said apparatus is sufficiently small to be hand-held.

6. Apparatus as defined in claim 1, wherein at least one of said fork arms includes a barb extending upwardly from the end of said fork arm for engaging an article.

* * * * *